US005414913A

United States Patent [19]

Hughes

[11] Patent Number: 5,414,913

[45] Date of Patent: May 16, 1995

[54] ULTRAVIOLET PROTECTIVE FABRIC

[75] Inventor: Shaun N. G. Hughes, Seattle, Wash.

[73] Assignee: Wetmore Associates, Seattle, Wash.

[21] Appl. No.: 881,939

[22] Filed: May 12, 1992

[51] Int. Cl.[6] ..... D06C 11/00

[52] U.S. Cl. ..... 26/29 P; 8/494; 34/381; 28/100; 28/167; 28/169

[58] Field of Search ..... 28/167, 169, 100; 51/393; 26/29 P; 8/494; 34/381

[56] References Cited

U.S. PATENT DOCUMENTS

| | | |
|---|---|---|
| 4,316,928 | 2/1982 | Otto . |
| 4,343,045 | 8/1982 | Ferrari . |
| 4,435,442 | 3/1984 | Hefele . |
| 4,467,738 | 9/1984 | Himelreich, Jr. . |
| 4,469,739 | 9/1984 | Gretzinger et al. . |
| 4,520,143 | 5/1985 | Jellinek . |
| 4,546,493 | 10/1985 | Bortnick . |
| 4,631,226 | 12/1986 | Jellinek . |
| 4,636,428 | 1/1987 | Bruner et al. . |
| 4,793,668 | 12/1988 | Longstaff . |
| 4,820,508 | 4/1989 | Wortzman . |
| 4,861,651 | 8/1989 | Goldenhersch . |
| 4,900,608 | 2/1990 | Stamper . |
| 5,024,875 | 6/1991 | Hill et al. . |
| 5,048,441 | 9/1991 | Quigley . |
| 5,066,082 | 11/1991 | Longstaff . |
| 5,071,699 | 12/1991 | Pappas et al. . |

FOREIGN PATENT DOCUMENTS

| | | |
|---|---|---|
| 0194564 | 3/1986 | European Pat. Off. . |
| 0210971 | 2/1987 | European Pat. Off. . |
| 2540355 | 8/1984 | France . |
| 63162798 | 7/1963 | Japan . |
| 64-52783 | 2/1989 | Japan . |
| 3-124841 | 5/1991 | Japan . |
| 3-234864 | 10/1991 | Japan . |
| 9105897 | 2/1991 | WIPO . |

*Primary Examiner*—James J. Bell
*Attorney, Agent, or Firm*—Christensen, O'Connor, Johnson & Kindness

[57] ABSTRACT

A fabric having both a high degree of user comfort and a high degree of Ultraviolet Radiation protection is provided. The preferred yarn is at least 40 Denier by 40 Denier, preferably 70 Denier by 2\70 Denier Nylon Yarn. The yarn is woven into a fabric with a yarn count of at least 80 by 50, preferably about 118 by 68 yarns per inch. The fabric is sanded, preferably moderate to heavy, on one side. The fabric is jet treated, preferably air jet laundered. The fabric provides an Ultraviolet sun protection factor of at least about 30, preferably about 70 or more.

4 Claims, 5 Drawing Sheets

ULTRAVIOLET PROTECTIVE FABRIC

The present invention relates to fabric for providing protection against Ultraviolet Radiation and, in particular, woven fabric which provides a high degree of wearer-comfort while providing a high Ultraviolet sun protective factor.

BACKGROUND OF THE INVENTION

With the increasing awareness of dangers posed to human health by over-exposure to solar radiation and, particularly, Ultraviolet components of radiation, a number of attempts have been made to provide protection from such radiation while permitting outdoor activities. Among the protective measures available are various types of clothing. The degree of protection against Ultraviolet Radiation afforded by clothing is highly variable and depends on a number of factors. Among these factors is the Ultraviolet characteristics of the yarn or fiber of the fabric and the type of weave of the fabric. The characteristics of the weave of the fabric which are of interest include the ratio of the surface area which is occupied by the fibers or yarns to the area of the apertures between the yarns. The principal determinates of this ratio are the tightness of weave (typically measured as the finished yarn count (FYC) or yarns per inch) and the thread size (typically expressed as a Denier number). The characteristics of the yarn which are of principal interest are the transmission characteristics of the yarn or fiber, particularly the percent of Ultraviolet Radiation which is transmitted through or along the fiber or yarn, as opposed to being absorbed or reflected.

In attempting to provide radiation protection, one approach to dealing with the ratio of threads to apertures is to provide a fabric having a relatively tight weave, or a very high thread count. Another approach involves coating the fabric. Both of these approaches greatly reduce or eliminate the apertures in the fabric. While this may increase Ultraviolet protection, it results in a fabric which is uncomfortable. It is believed that the lack of comfort arises from the reduction or elimination of the apertures in a fashion which makes it impossible for the fabric to "breathe". This is an undesirable approach for achieving Ultraviolet protection since it discourages users from wearing the fabric particularly during hot weather when exposure to Ultraviolet Radiation is most likely. Accordingly, there is need for a sun-protective fabric, and particularly an Ultraviolet protective fabric which is also comfortable, particularly in warm weather.

SUMMARY OF THE INVENTION

According to the present invention, a fabric is provided which provides both a high degree of user comfort and desirable protection from Ultraviolet Radiation. Preferably the fabric provides at the UV protection generally associated with acceptable radiation-protective clothing, such as on SPF of about 30 or more. In one embodiment, the fabric provides for at least partially blocking UV Radiation through the apertures while permitting air circulation or "breathing" through the apertures. Preferably, some of the fibers of the yarn are relaxed, loosened, or severed, such as by sanding and\or jet treatment, such that the loosened or severed fibers cover portions of the apertures while still permitting air circulation or "breathing" of the fabric. In one embodiment the sanded surface is the surface which is presented to the source of Ultraviolet Radiation. When the fabric is formed into clothing, the clothing is formed with the sanded side out to provide both desired air circulation and a high degree of Ultraviolet blockage. In one embodiment, nylon yarns of at least about 40 Denier, preferably about 70 Denier, are woven, preferably in a 1 warp yarn×2 fill yarn pattern, to provide a fabric with a finished yarn count of at least about 80, preferably about 118 yarns per inch in the warp yarns and at least about 50, preferably about 68 yarns per inch in the fill yarns. In this embodiment, the fabric is sanded on one side, and, after optional dyeing, is air jet laundered. The resulting fabric provides an Ultraviolet solar protection factor of at least about 30, preferably at least about 40, more preferably at least about 50 even more preferably, at least about 70 and most preferably about 80 or more (in white, which blocks less UV than any other color).

DESCRIPTION OF THE PREFERRED EMBODIMENT

Figure 1:
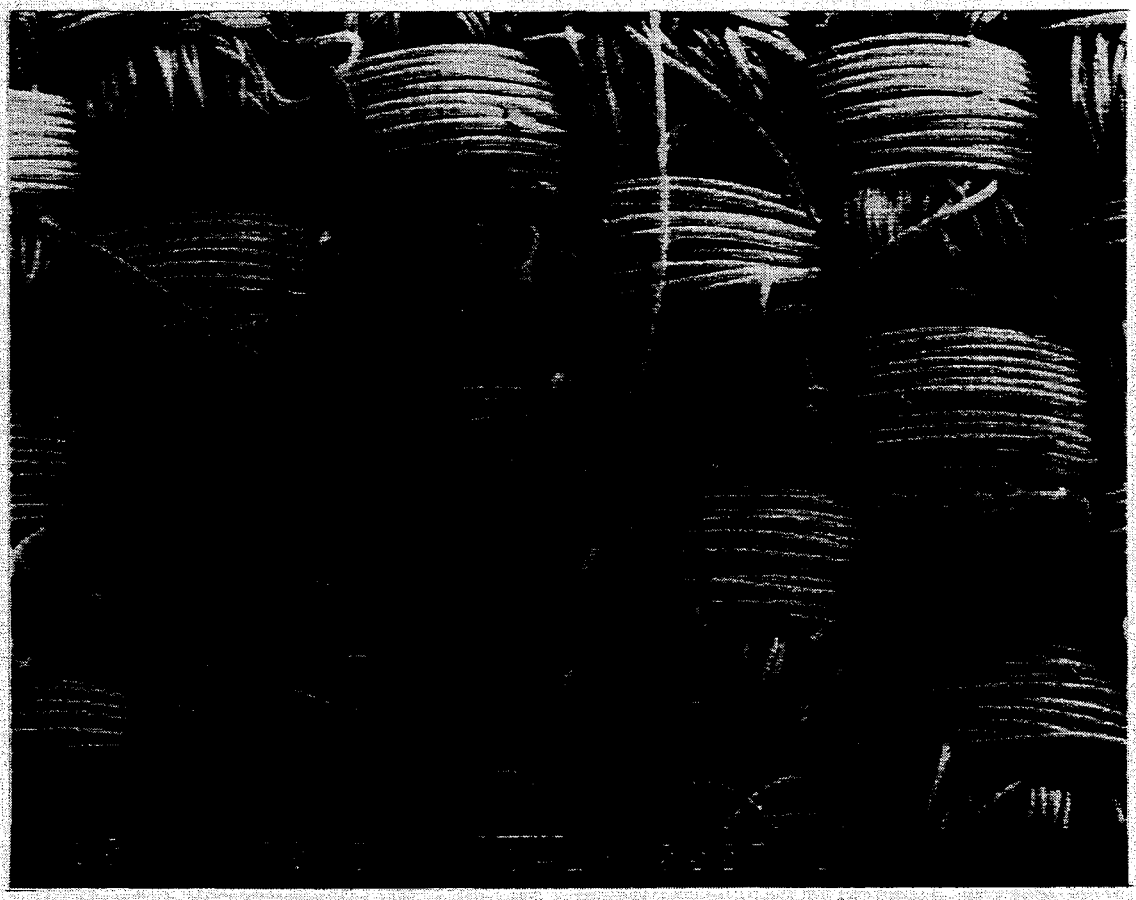
FIG. 1 is a photomicrograph of the fabric according to the present invention, with a 142 micron scale shown thereon, depicting the reverse (non-sanded) side of the fabric after sanding and air jet laundering.
Figure 2:
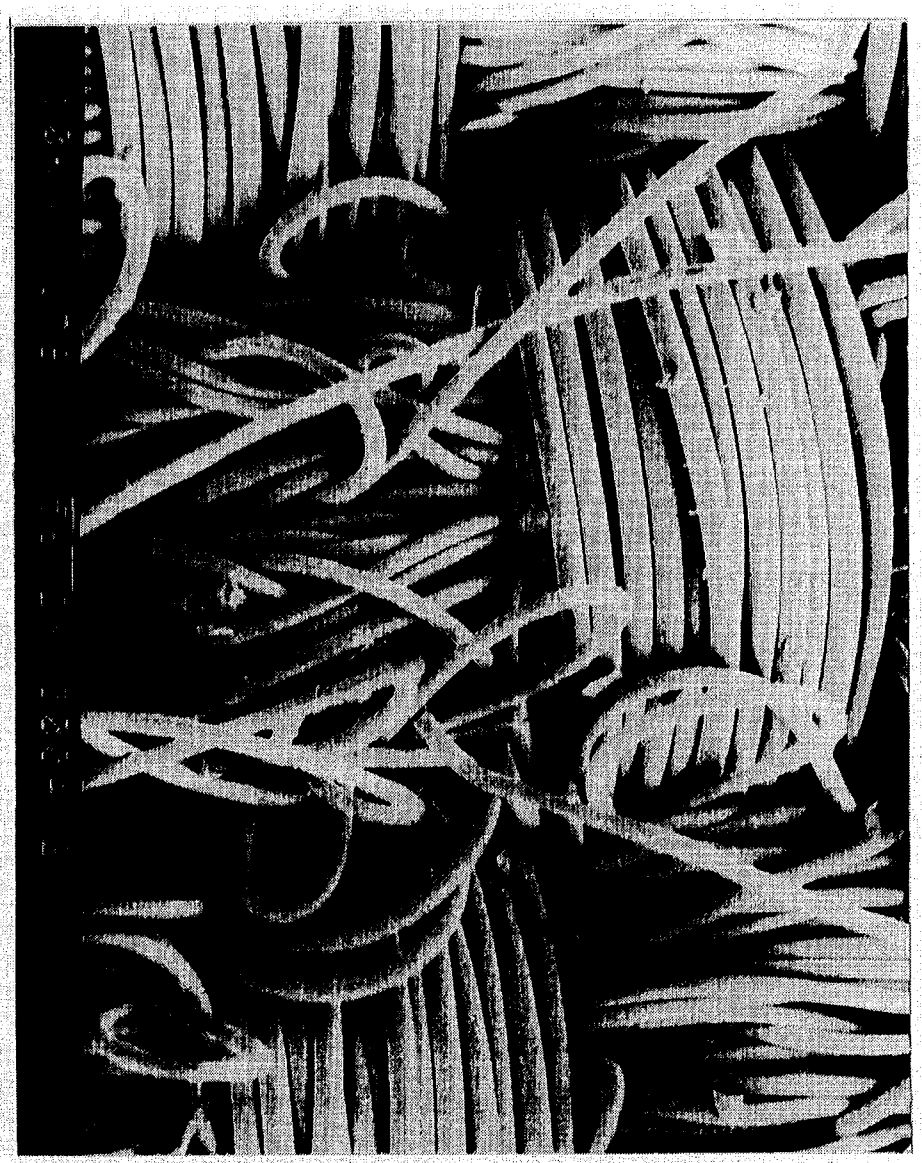
FIG. 2 is a photomicrograph corresponding to FIG. 1 but with higher magnification, with a 56.2 micron magnification scale depicted thereon.

As depicted in FIG. 1, the yarn used in an embodiment of the present invention is a multiple filament yarn. In one embodiment the fibers are formed from nylon, such as nylon 6,6, into a yarn such as that sold under the name "Supplex®" by E. I. DuPont de Nemours & Co. Other types of nylon yarn may also be operable such as those available from Courtaids, Allied, and BASF. In this embodiment the warp yarn size is at least about 40 Denier, preferably in the range of between about 68 and 76 Denier (e.g. as determined in accordance with American Standards for Testing of Material (ASTM) D 1059–87) and most preferably having a nominal yarn size of about 70 Denier. In one embodiment the warp yarn has about 34 filaments and the two fill yarns have about 66 filaments. In one embodiment the weave (described below) is a 1×2 weave, providing a nominal yarn size of about 70 Denier (warp) by 2\70 Denier (fill). In this embodiment the warp yarn is single ply and the weft yarn is two-ply. Both have little or no twist (which is believed to allow them to flatten out during the fabrication). FIGS. 1 through 4 depict the 1×2 weave used in producing the fabric according to this embodiment of the invention. The fabric woven in this fashion has a finished yarn count for the warp yarns in the range of about 80 to about 200 yarns per inch, preferably 80 to about 150 yarns per inch, more preferably about 100 to 130 yarns per inch, still more preferably having between about 116 and about 119 yarns per inch (e.g. as determined according to ASTM D. 3775–85) and most preferably having a nominal finished yarn count of about 118 yarns per inch. The fill yarns preferably have a finished yarn count of at least about 50, more preferably between about 64 and about 78 yarns per inch (e.g. as determined according to ASTM D 3775-85) and most preferably having a nominal finished yarn count of about 68 yarns per inch. In this embodiment, the fabric has a fabric weight (e.g. as determined in accordance with ASTM D 3776) of about 3.0 ounces per square yard (about 160 grams per square meter). "Nominal" refers to specifications as employed by fabric mills for determining characteristics of produced fabrics. A fabric of this nature can be produced, for example, by Brookwood Companies (South Carolina Mills), particularly in connection with finishing (as described below) at Pioneer Finishing Corporation, Fall River, Mass.

Figure 3:
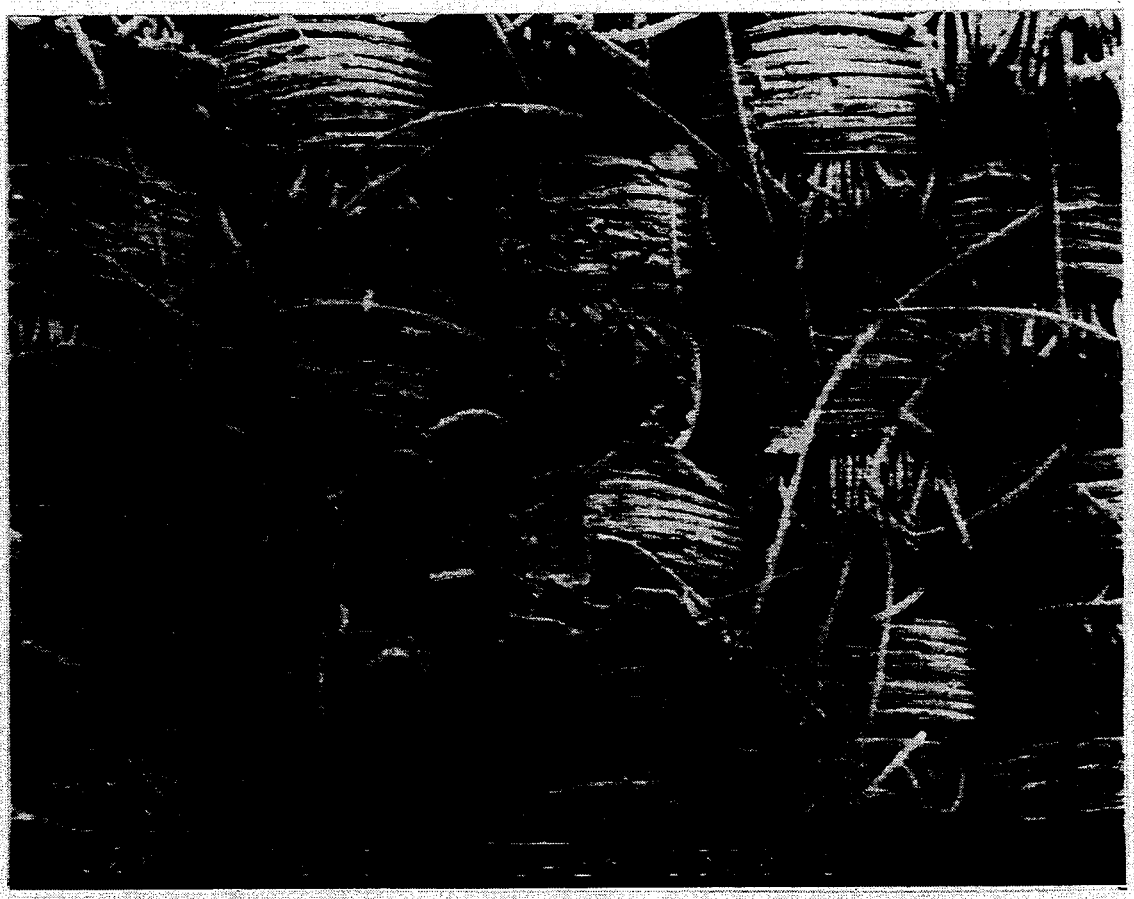
FIG. 3 is a photomicrograph corresponding to FIG. 1 but showing the opposite (sanded) side of the fabric.
Figure 4:
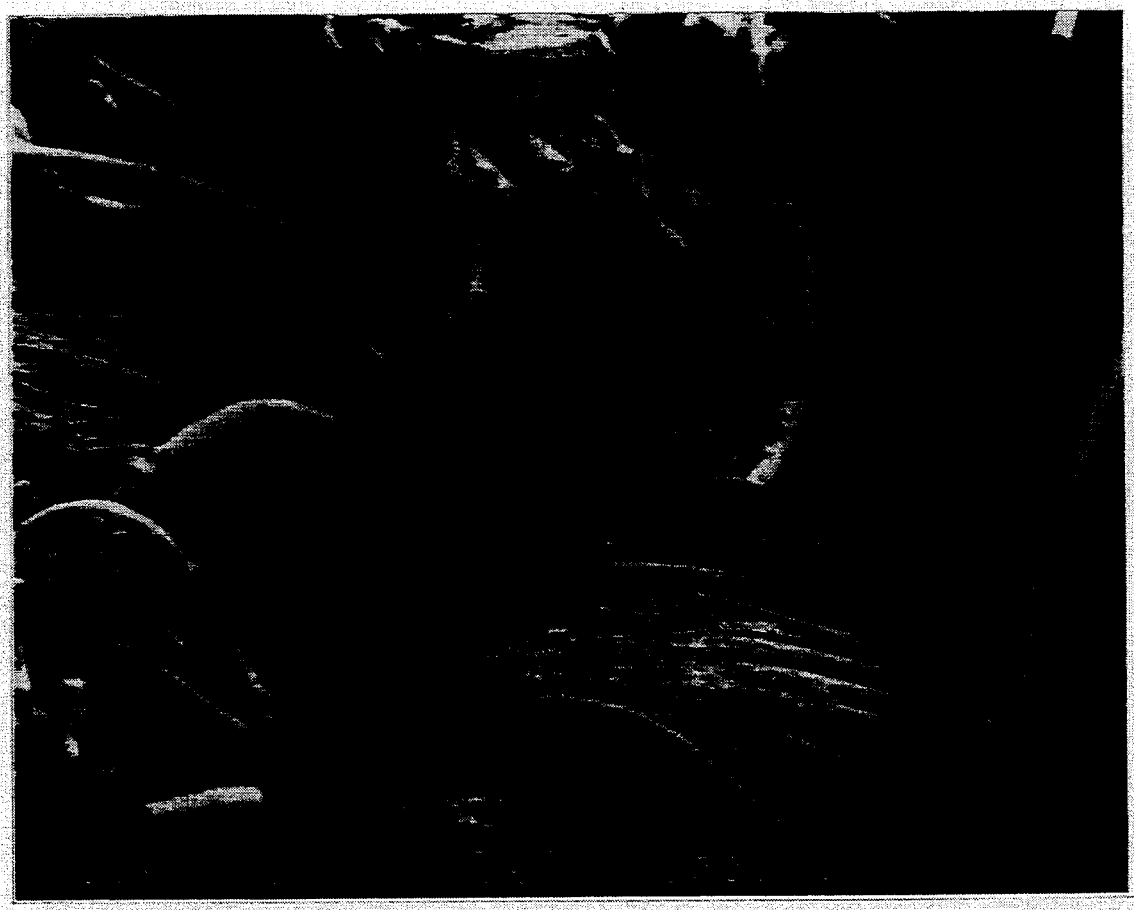
FIG. 4 is a photomicrograph corresponding to FIG. 3 but having a greater magnification with a 56.2 micron magnification scale depicted thereon.

The woven fabric, according to this embodiment, is subjected to sanding using fabric sanding methods known to those skilled in the art. In general, sanding includes running fabric stock over an abrasive surface such as a sanded surface. Sanding variables include sandpaper grit, number of fabric passes over sanded surfaces and tension on fabric or pressure on sanded surface. The values employed for those variables are selected in a manner known to those skilled in the art. In particular, the sanding machine operator employs his knowledge to pick the appropriate combination of values based upon fabric composition to achieve the proper degree of sanding. In one embodiment, the fabric is sanded substantially as heavily as possible without weakening the fabric of the point where integrity and durability of the fabric is seriously compromised. According to this embodiment, the degree of sanding is the degree at least as depicted in FIGS. 3 and 4 and described in the industry as "moderate to heavy sanding". According to this embodiment, following sanding, the fabric may be optionally dyed, as described more thoroughly below. After the sanding (and immediately after dyeing) the fabric is subjected to an air jet laundering process (using techniques known to those skilled in the art) to relax the fabric and dumped into a collection bin. Preferably, after jet laundering, the fabric is allowed to dry. In the present embodiment, the fabric, which typically shrinks during the laundering process, is not stretched (contrary to the norm in the industry) and is not rolled onto a collection spool and therefore has puckered appearance.

The fabric produced as described above results in a high degree of user comfort and a high degree of Ultraviolet Radiation blockage. The precise theory explaining this desirable combination of characteristics is not fully known. However, without wishing to be bound by any theory, it is believed that the weave, the sanding and the jet treatment are factors. In the embodiment described, the warp threads are thinner than the fill threads (approximately 70 Denier versus 140 Denier, combined). It is believed that this allows the fill yarn filaments to block the apertures formed between the yarns when the filaments are relaxed and sanded and also permits the fabric from becoming too weak after the described treatment. As seen in FIGS. 1 through 4, the fill yarns are believed to have a higher degree of looping than the warp yarns.

It is believed that the sanding process raises the yarn filaments and breaks them. This releases tension on some of the fibers of the yarns. It is believed that some of the broken filaments, in turn, fill or cover at least some of the apertures, blocking UV Radiation before it reaches the apertures, without undesirably blocking air flow or "breathing" of the fabric. Further, the broken filaments are believed to help raise the height of the fabric, keeping the body of the fabric from touching the skin when used in a garment. This creates an air space that is believed to make the fabric more comfortable. This airspace is believed to helps diffuse UV radiation, which, it is believed, helps to make the fabric more UV protective. The effect of sanding can be seen in FIGS. 3 and 4 which depict the sanded side of the fabric, compared to the unsanded side depicted in FIGS. 1 and 2.

The air jet laundering process is believed to help relax the yarns after fabrication. It also causes a degree of fabric shrinkage. Further, it is believed that the jet laundering may cause individual filaments of the yarns to rise from the fabric, to develop loops, and to fill some of the fabric apertures. Because some of the filaments are broken during the sanding process, it is believed the yarn filaments on both sides of the fabric become more relaxed during the jet laundering process. The jet laundering is believed to also reduce the size of the apertures.

As noted above, the fabric may be optionally dyed, preferably following sanding and before jet laundering. In many cases dyeing substantially affects the sun protective factor of the fabric. For example, it has been found that the fabric according to the present invention which, in a white state has a sun protective factor of about 40, if the fabric is dyed black will have a substantially higher sun protective factor, such as a sun protective as high as about 450. Accordingly, references herein to "Sun Protective Factor" of the fabric refer to the sun protective factor of a fabric in a white state. In the above example, the black fabric having a sun protective factor of 450 has a white sun protective factor of 40.

In one embodiment, the fabric formed according to the present invention is included in clothing such as shirts, pants, blouses, dresses, children's cover-ups, scarves, hats, gloves, coats, hoods, neck gators and the like. As noted, in one embodiment, the fabric is sanded on one side only. It is possible to construct clothing with the sanded side on the inside or outside of clothing. However, in at least one embodiment it is believed that greater Ultraviolet protection is provided with the sanded side on the outside of the garment. Accordingly, in one embodiment, when it is desired to provide the highest Ultraviolet protection, the garment is constructed with the sanded side out.

EXPERIMENTAL

Figure 5:
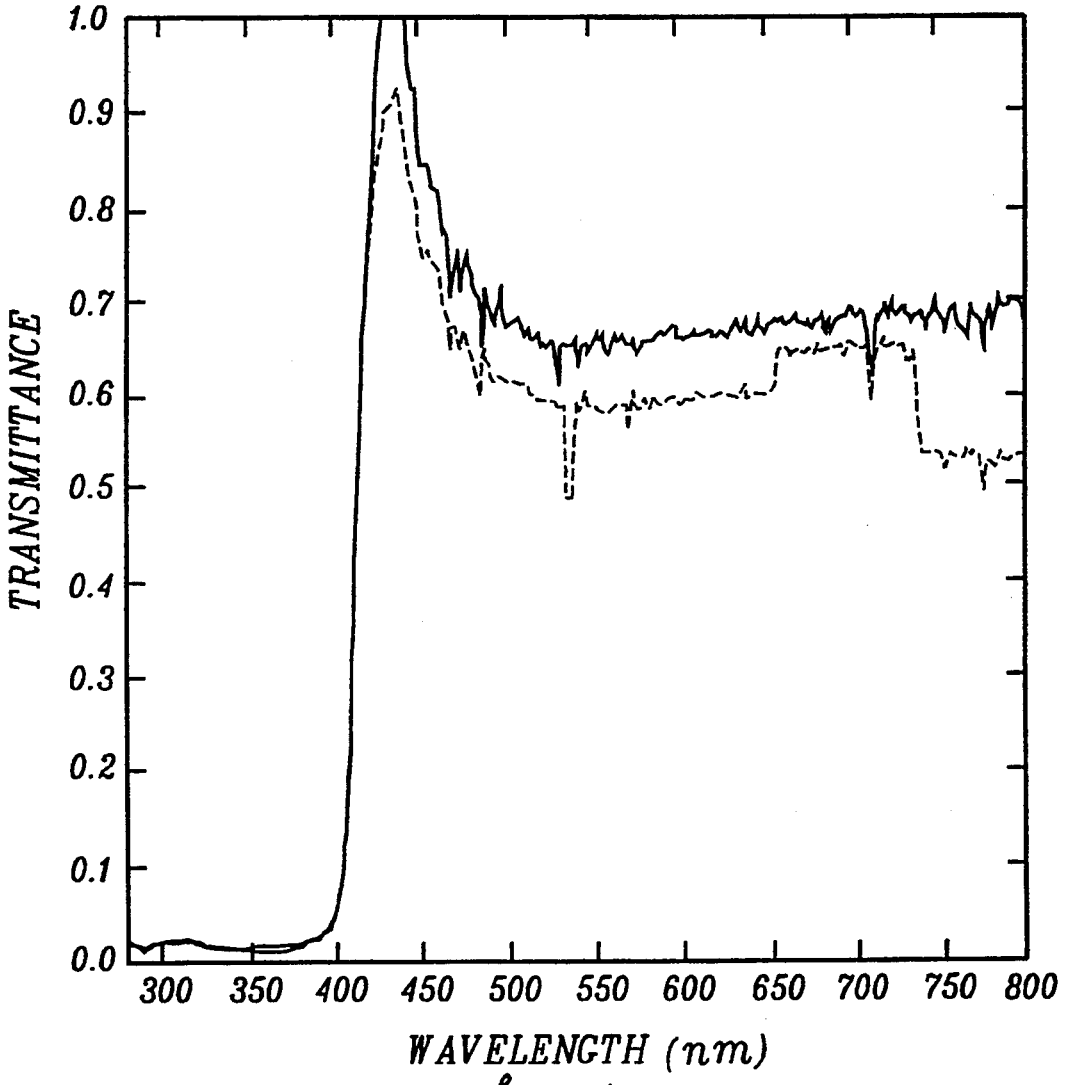
FIG. 5 depicts a transmittance spectrum for a fabric according to an embodiment of the present invention.

A fabric was woven in a 1×2 pattern from DuPont Supplex® Nylon Multiple Filament Yarn having a yarn size of 70 Denier (warp) by 2\70 Denier (fill or weft). The fabric was woven with a nominal finished yarn count of 118 (warp) by 68 (fill) yarns per inch. The woven fabric was sanded on one side only, dyed, jet laundered and air dried. The resulting fabric had a microstructure substantially as depicted in FIGS. 1 through 4. Ultraviolet transmittance through the fabric was measured for wavelengths from about 280 nanometers to about 800 nanometers. Three scans were performed and averaged. The procedure was run twice with the only difference being that the second run involved a greater degree of stretching of the fabric than the first run. The solid trace represents transmittance for the undyed (white) fabric in a dry state. The dotted trace represents transmittance in the wet state. The results from the second run are depicted in FIG. 5.

Based on the transmittance data obtained, predicted sun protection factors, based upon the spectrum, were calculated as shown in Table I.

TABLE I

| | Predicted SPF | | |
|---|---|---|---|
| | Total | uvb | uva |
| First run: | | | |
| dry | 58.6 | 56.7 | 70.7 |
| wet | 55.6 | 53.5 | 69.9 |
| Second run: | | | |
| dry | 42.0 | 41.0 | 48.6 |
| wet | 49.8 | 48.3 | 58.9 |

In Table I, "uvb" denotes the SPF in the uvb spectrum, 290–320 nm and "uva" denotes the SPF in the uva spectrum, 320–400 nm. "Total" denotes the well known sun protection factor (SPF). In general, SPF indicates the number of time units of protected exposure which is equivalent to one time unit of unprotected exposure.

A second comparison fabric was tested in which the ratio of thread size to thread count was decreased (by decreasing the yarn size while increasing the thread count). In the second fabric, the yarn size was about 140 Denier (warp) and \166 Denier (fill) and the thread count was about 90 yarns per inch (warp) and about 132 yarns per inch (fill). It was found that even though decreasing the ratio is expected to have the effect of decreasing the aperture size, the amount of UV protection in the second test fabric was decreased.

A third comparison fabric was prepared in which jet laundering was not used. It was found that a maximum SPF of about 45 was achieved without using air jet laundering, compared with a maximum SPF of about 70 for a comparable fabric subjected to air jet laundering.

A fourth comparison fabric was provided which was otherwise comparable but was not sanded. The feel of this unsanded material was compared to the feel of the sanded material according to the present invention and the fourth test fabric was judged to be less comfortable. Additionally, the UV protection of the unsanded fourth test fabric had an Ultraviolet protection substantially inferior to that of the sanded fabric.

In light of the above description, a number of advantages of the present invention are apparent. The present invention provides a fabric that affords a high degree of protection from Ultraviolet Radiation without the need for utilizing special Ultraviolet—blocking fibers and without the need for special Ultraviolet—blocking coatings. The present invention retains breathability of the fabric, contributing to the high degree of user comfort. When the fabric is included in clothing, according to the present invention, the wearer receives a high degree of comfort while enjoying protection from Ultraviolet Radiation.

Although the present invention has been described by way of a preferred embodiment, certain variations and modifications of the invention can also be used. The present invention could be combined with other types of Ultraviolet protection such as dyeing or use of Ultraviolet—blocking fibers. It is possible to use some aspects of the invention without using others, such as by providing a sanded fabric without providing the sanded side on the outside of the clothing article.

Although the application has been described by way of a preferred embodiment and certain variations and modifications, other variations and modifications can also be used, the invention being defined by the following claims.

What is claimed is:

1. A method for fabricating a fabric having high wearer-comfort comprising:

providing a plurality of multi-filament nylon warp yarns having a yarn size of about 70 denier;

providing a plurality of multi-filament nylon fill yarns having a yarn size of about 70 denier;

weaving said warp yarns and said fill yarns in a 1×2 pattern to provide a fabric with a finished yarn count of about 118 yarns per inch of said warp yarns and about 68 yarns per inch of said fill yarns to provide a fabric with a weight of about 3 ounces per square yard, said fabric having first and second surfaces;

sanding only said first surface of said fabric substantially to the degree depicted in FIG. 3;

dying and jet laundering said fabric, following said step of sanding;

collecting said fabric in a collection region;

air-drying said fabric, in the absence of stretching said fabric after said drying and jet laundering, to provide a fabric having a sun protective factor of at least about 30.

2. A method, as claimed in claim 1, wherein said fabric is provided with a sun protective factor of at least about 40.

3. A method, as claimed in claim 1, wherein said fabric is provided with a sun protective factor of at least about 50.

4. A method, as claimed in claim 1, wherein said fabric is provided with a sun protective factor of at least about 80.

* * * * *

UNITED STATES PATENT AND TRADEMARK OFFICE

CERTIFICATE OF CORRECTION

PATENT NO. : 5,414,913

DATED : May 16, 1995

INVENTOR(S) : S.N.G. Hughes

It is certified that error appears in the above-indentified patent and that said Letters Patent is hereby corrected as shown below:

| COLUMN | LINE | |
|---|---|---|
| 1 | 45 | ""breathe"." should read --"breathe."-- |
| 2 | 16 & 17 | "about 50 even more preferably," should read --about 50, even more preferably-- |
| 2 | 33 | After "thereon;" insert --and-- |
| 2 | 45 | "Courtaids" should read --Courtalds-- |
| 2 | 48 | After "e.g." insert --,-- |
| 2 | 67 | After "e.g." insert --,-- |
| 3 | 4 | After "e.g." insert --,-- |
| 3 | 7 | After "e.g." insert --,-- |
| 3 | 31 | "of" should read --to-- |
| 3 | 35 | ""sanding"." should read --"sanding."-- |
| 5 | 24 | "\166" should read --166-- |

UNITED STATES PATENT AND TRADEMARK OFFICE

CERTIFICATE OF CORRECTION

PATENT NO. : 5,414,913

DATED : May 16, 1995

INVENTOR(S) : S.N.G. Hughes

It is certified that error appears in the above-indentified patent and that said Letters Patent is hereby corrected as shown below:

| COLUMN | LINE | |
|---|---|---|
| 6 (Claim 1, | 35 line 16) | "dying" should read --dyeing-- |
| 6 (Claim 1, | 39 line 20) | "drying" should read --dyeing-- |

Signed and Sealed this

Nineteenth Day of December, 1995

Bruce Lehman

*Attest:*

BRUCE LEHMAN

*Attesting Officer*

*Commissioner of Patents and Trademarks*